US008979568B2

(12) United States Patent
Herbrechtsmeier et al.

(10) Patent No.: US 8,979,568 B2
(45) Date of Patent: Mar. 17, 2015

(54) ELECTRICAL PLUG-IN CONNECTOR HAVING LOCKING CLIPS

(75) Inventors: Heiko Herbrechtsmeier, Buende (DE); Uwe Sundermeier, Espelkamp (DE); Gero Degner, Minden (DE)

(73) Assignee: Harting Electric GmbH & Co. KG, Espelkamp (DE)

( * ) Notice: Subject to any disclaimer, the term of this patent is extended or adjusted under 35 U.S.C. 154(b) by 197 days.

(21) Appl. No.: 13/579,360

(22) PCT Filed: Dec. 2, 2010

(86) PCT No.: PCT/DE2010/075150

§ 371 (c)(1), (2), (4) Date: Aug. 16, 2012

(87) PCT Pub. No.: WO2011/100942

PCT Pub. Date: Aug. 25, 2011

(65) Prior Publication Data

US 2012/0315782 A1 Dec. 13, 2012

(30) Foreign Application Priority Data

Feb. 16, 2010 (DE) ..... 20 2010 002 396 U

(51) Int. Cl.
*H01R 13/625* (2006.01)
*H01R 13/629* (2006.01)

(52) U.S. Cl.
CPC .... *H01R 13/62966* (2013.01); *H01R 13/62938* (2013.01)
USPC ..... 439/346

(58) Field of Classification Search
USPC ..... 439/346.157, 160, 152, 153, 368, 439/607.55, 370, 372, 341–343, 376, 238, 439/261, 288, 312, 838, 769–772, 806, 246, 439/252, 378
See application file for complete search history.

(56) References Cited

U.S. PATENT DOCUMENTS 5,658,162 A * 8/1997 Harting et al. ..... 439/372
6,004,162 A * 12/1999 Harting et al. ..... 439/701

(Continued)

FOREIGN PATENT DOCUMENTS

DE 195 08 605 7/1996
DE 20 2005 020026 3/2006

(Continued)

*Primary Examiner* — Abdullah Riyami
*Assistant Examiner* — Harshad Patel
(74) *Attorney, Agent, or Firm* — Jacobson Holman, PLLC.

(57) ABSTRACT

The invention relates to an electrical plug-in connector, comprising a first and a second housing half, the first housing half (2) having two opposite U-shaped locking clips (8), which are each pivotably retained on both sides on bearing journals (12) and which each have locking projections (9) on both sides, the locking projections having a recess (11), wherein said recesses act on locking pins (13) of the second housing (3) when the locking clips (8) are closed so that the two housing halves (2, 3) are pressed against each other, characterized in that the first housing half (2) has at least one web (4), which penetrates a recess (6) of the second housing half (3) intended therefore when the two housing halves (2, 3) are joined so that the housing halves lie against each other in an accurately fitting manner, and in that the locking clips (8) have lateral shields (7), which cover the bearing journals (12) of the first housing half (2) and the locking pins (13) of the second housing half (3) in the locked state of the system plug-in connector, wherein each shield (7) has a straight edge (17) between the bearing journal receptacle (22) and the locking pin (13).

10 Claims, 3 Drawing Sheets

(56) References Cited

U.S. PATENT DOCUMENTS

Figure 1:
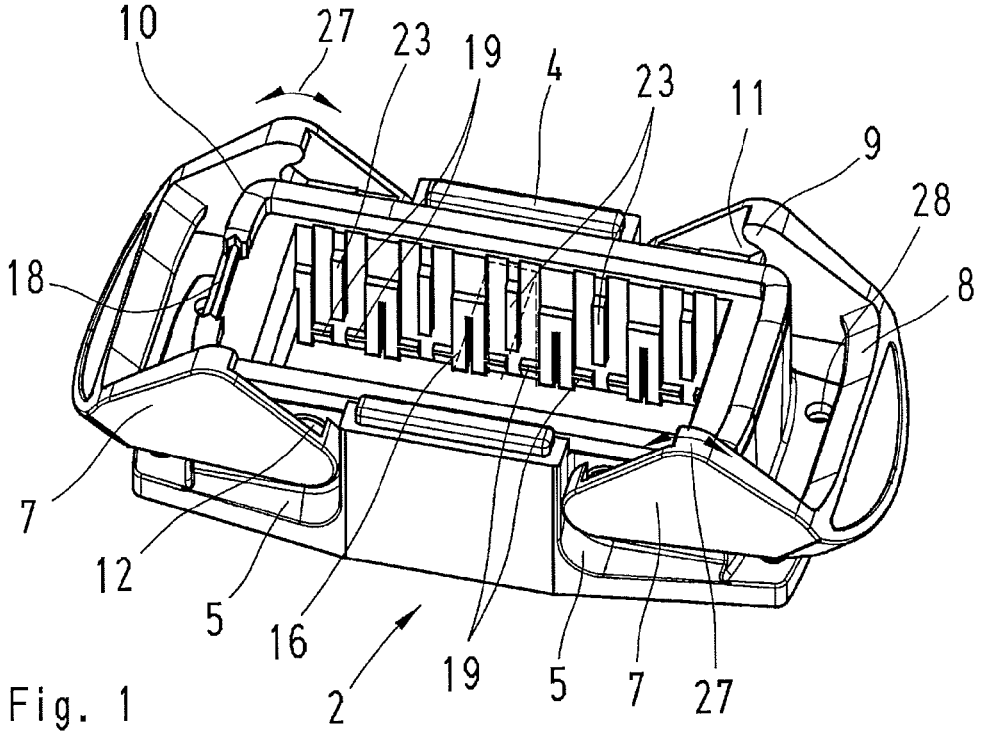

| | | | | |
|---|---|---|---|---|
| 6,659,808 | B2 * | 12/2003 | Billman et al. | 439/680 |
| 7,597,562 | B2 * | 10/2009 | Genesius et al. | 439/372 |
| 7,717,723 | B2 * | 5/2010 | Nehm | 439/157 |
| 7,997,938 | B2 * | 8/2011 | Costello et al. | 439/660 |
| D648,275 | S * | 11/2011 | Spilker et al. | D13/133 |
| 2007/0155237 | A1 | 7/2007 | Cairns et al. | |
| 2007/0155252 | A1 | 7/2007 | Ferderer | |
| 2009/0258530 | A1 * | 10/2009 | Nehm | 439/372 |

FOREIGN PATENT DOCUMENTS

| | | |
|---|---|---|
| DE | 10 2007 019713 | 10/2008 |
| WO | WO 2008/132180 | 11/2008 |

* cited by examiner

ELECTRICAL PLUG-IN CONNECTOR HAVING LOCKING CLIPS

This is a national stage of PCT/DE10/075150 filed Dec. 2, 2010 and published in German, which has a priority of German no. 20 2010 002 396.3 filed Feb. 16, 2010, hereby incorporated by reference.

The invention relates to an electric plug-in connector, comprising a first and a second housing half, with the first housing half showing two opposite U-shaped locking bars, respectively held articulate at both sides on bearing pins and each showing latching cams at both sides, which are provided with a recess each engaging the latching cams of the second housing half upon closing of the locking bar such that both housing halves are pressed against each other.

Plug-in connectors with locking bars are necessary in order to ensure a reliable electric contact and to prevent any accidental pulling apart of the housing halves of the plug-in connector.

PRIOR ART

In electric plug-in connectors the housing halves are frequently pressed against each other via so-called locking bars in order to ensure a reliable contact of the electric contact elements of both housing halves. In order to prevent any media, such as dust or water, from entering into the plug-in connector housing, frequently a sealing ring is provided between the housing halves, with its sealing effect being ensured by the force applied by the locking bar between the bearing pin and the locking pin and thus between the housing halves.

DE 195 08 605 C1 (U.S. Pat. No. 5,658,162) shows, for example, an electric plug-in connector which comprises locking bars for a reliable locking of the housing halves, in which spring elements are implemented. These spring elements apply a force upon the respective locking pins.

When the housing halves of the electric plug-in connector are not positioned precisely aligned prior to the locking process, the electric contact elements of the respective housing halves are not positioned perpendicularly on top of each other. Accordingly, on the one hand, here the locking process of the plug-in connector is aggravated and on the other hand the wear and tear of the electric contact elements is increased by shearing forces developing.

When in the above plug-in connector a misalignment of the housing halves is given and the locking bar is guided over the locking pins, the springs implemented in said bar are excessively stretched on one side and quickly lose their spring force so that a reliable locking of the plug-in connector halves is no longer ensured.

OBJECTIVE

The objective of the invention comprises suggesting an electric plug-in connector with locking bars, which ensures a low-wear plugging in of electric contact elements and simultaneously a reliable locking of the housing halves of the plug-in connector.

The objective is attained in that the first housing half comprises at least one bar inserting into the recess of the second housing half provided for this purpose during the assembly of the two housing halves such that the housing halves prior to locking are located precisely aligned in reference to each other and that the locking bars show lateral shields which in the locked state of the system plug-in connector cover both the bearing pins of the first housing half as well as the locking pins of the second housing half with the respective shields, showing a straight flank between the bearing pin accept and the locking pin.

Advantageous embodiments of the invention are disclosed in the dependent claims.

The electric plug-in connector according to the invention comprises two housing halves, which can be locked to each other with the help of two opposite U-shaped locking bars. The particular feature of the locking bar comprises that they show lateral shields which cover the locking-relevant parts, such as bearing pins, latching cams, and latching hooks in the locked state. This way the parts are protected from environmental influences, among other things.

Additionally, the locking pins are guided behind the shield into the recesses of the locking pins, allowing a secure and homogenous locking process.

In order to avoid any stress of the plug-in modules during the locking process by shearing forces developing, the first housing half shows at least one bar projecting in the plug-in direction, which during the assembly of the two housing halves immerses into a recess of the second housing half provided for this purpose so that the housing halves are precisely aligned in reference to each other.

The bar is embodied projecting from the first housing half in the plug-in direction such that during the insertion into the recess of the second housing half stability can be ensured, which otherwise is only given by the use of additional guide pins.

This way it is ensured that the housing halves of the plug-in connector are always precisely aligned in reference to each other during the locking process.

In order to protect the interior of an electric plug-in connector from media, such as dust and/or water, the first housing half comprises a circumferential collar suitable to accept a sealing ring.

The shield of the locking bar forms a straight flank from the latching cam to the bearing pin accept. In an advantageous embodiment of the invention, the flanks of the opposite locking bars are aligned parallel in reference to each other in the locked state.

It is advantageous for the first housing half to show accept or receiving sections for individual plug-in modules. The plug-in modules comprise electric contact elements. In each accept section different plug-in modules with different electric contact elements may be used.

The utility patent DE 202005020026 U1 (U.S. published application US 2007/0155252 A1) of the applicant discusses the equipment of a holding frame for electric plug-in connectors with plug-in modules. The content disclosed in this utility patent regarding the plug-in modules is included in the disclosed content of the present invention.

Latching cams, which can engage the matching recesses in the plug-in modules, are provided in order to fixate plug-in modules in the accept section of the first housing half 2.

In order to accept plug-in modules in the second housing half, a fastening frame is provided, which in turn shows accepting sections suitable to accept electric contacting elements in the form of separate plug-in modules.

In order to fixate the fastening frame in the second housing half, latching cams are provided engaging matching recesses of the second housing half.

When assembling the two housing halves, the opposite electric contact elements of the plug-in modules are also electrically contacted with each other.

By the ability to equip the electric plug-in connector with different plug-in modules, it can be used in various technical applications.

All components of the plug-in connector according to the invention may be produced from plastic. In a particularly preferred embodiment, the locking bar may be made from a different material than the plug-in connection housing halves 2, 3—for example, metal.

EXEMPLARY EMBODIMENT

Figure 2:
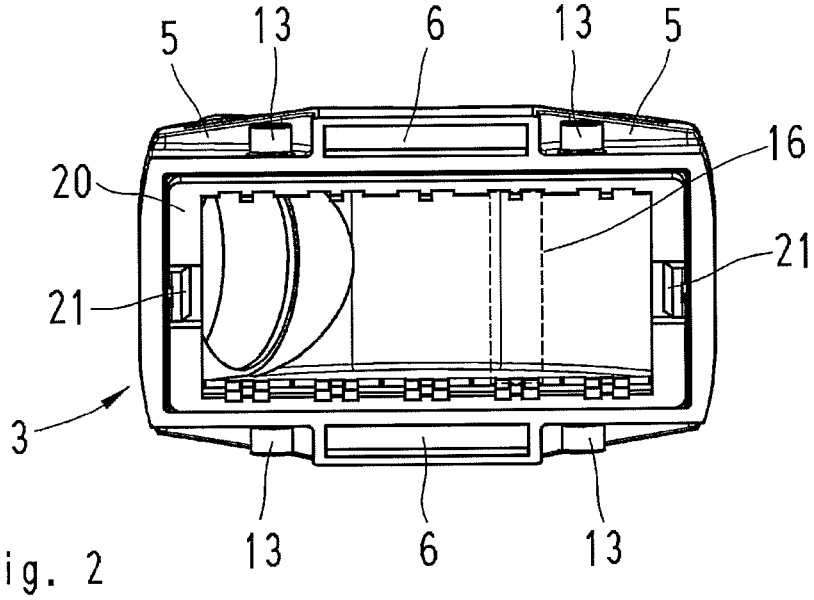
Figure 3:
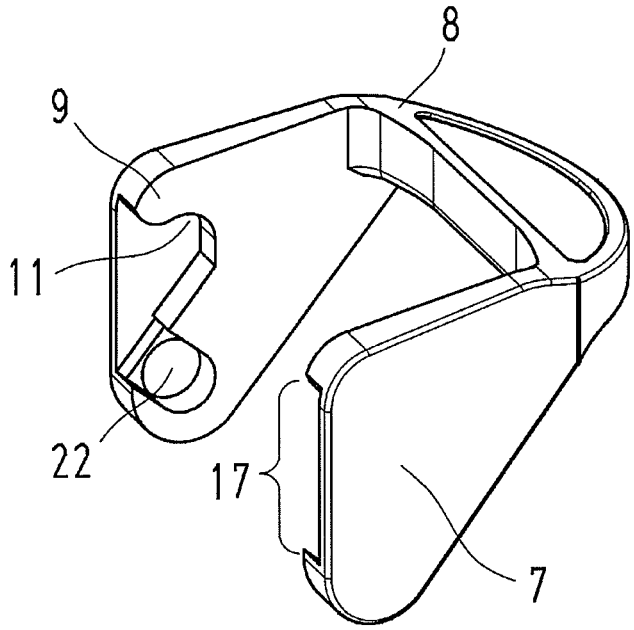
Figure 4:
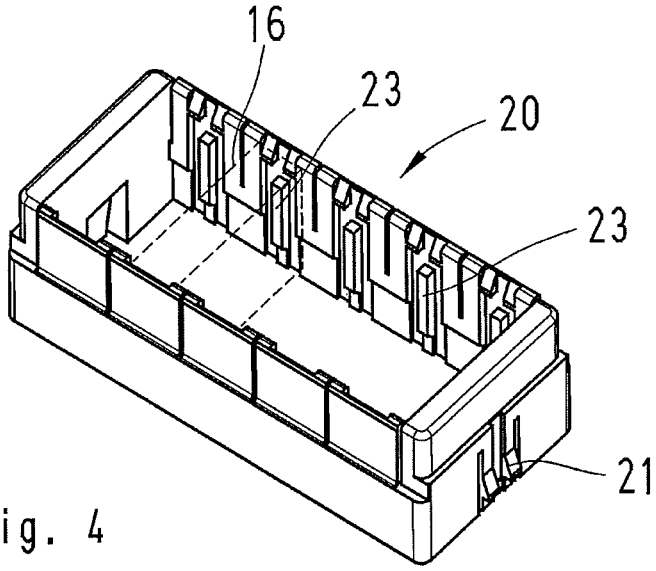
Figure 5:
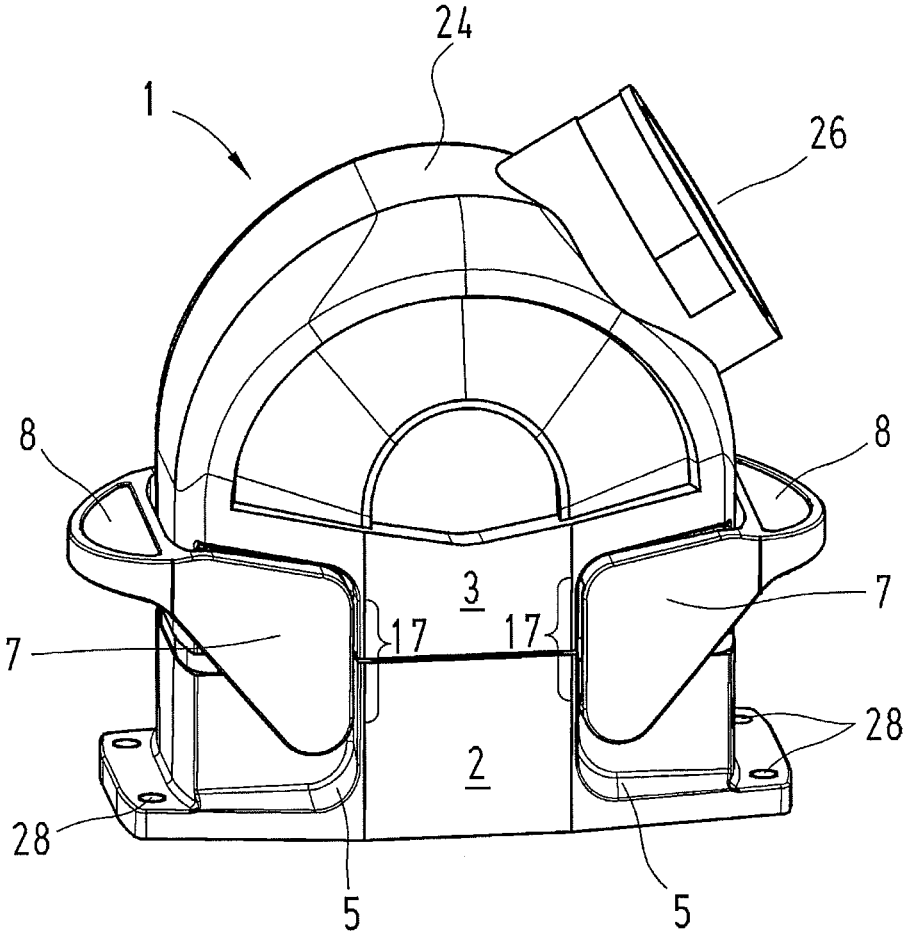

An exemplary embodiment of the invention is shown in the drawings and explained in greater detail in the following. In the figures:

FIG. 1 shows a perspective illustration of a first housing half of an electric plug-in connector, FIG. 2 shows a top view of a second housing half of the electric plug-in connector, FIG. 3 shows a perspective view of a locking bar of the electric plug-in connector, FIG. 4 shows a perspective view of a fastening frame for plug-in modules for the second housing half, and FIG. 5 shows a perspective view of an electric plug-in connector in the assembled state.

FIG. 1 shows the perspective illustration of a first housing half 2 of the electric plug-in connector 1 according to the invention.

The first housing half 2 shows an almost rectangular base area, which comprises accepting sections 16 into which plug-in modules can be inserted, not shown here, comprising electric contact elements. The plug-in modules form the plug-in section of the first housing half 2.

Bore holes 28 are inserted into the base area of the housing half 2. The bore holes are suitable to fasten (for example, via a screw connection) the housing half 2 to a generic component, for example, a machine housing.

In the exemplary embodiment shown here, the plug-in modules are inserted into the accepting section 16 of the housing half 2 provided for this purpose along the opposite rails 23. The accepting sections 16 for the plug-in modules are shown in FIGS. 1 and 2 in dot-dash lines, for example. The plug-in modules can engage latching hooks 19 of the accepting sections 16.

FIG. 2 shows a second housing half 3 of the electric plug-in connector 1. A separate fastening frame 20 is provided in order to equip the second housing half 3 with plug-in modules which can be latched in the second housing half via latching means 21. FIG. 4 shows such a fastening frame 20. The fastening frame 20 can similarly be equipped with plug-in modules like the first housing half 3.

The first housing half 2 comprises a collar 18, upon which a sealing ring 10 can be placed, which seals the completely assembled plug-in connection housing 1 from environmental influences, such as dust and moisture.

The first housing half 2 comprises bearing pins 12, which engage the bearing pin recesses 22 (FIG. 3) of the locking bar 8 such that the locking bar is held in an articulate fashion.

FIG. 3 shows such a locking bar 8. The latching cam and the bearing pin recess 22 of the bar 8 are covered by a lateral shield 7. The shield 7 ends with a straight connection line or a straight flank 17 at the lateral part of the locking bar 8. The bearing pin recess 22 is embodied deeper than the wall thickness of the lateral parts of the bars 8 such that the bars 8 cannot slip off the bearing pin 12 of the first housing, half 2. The first housing half 2 comprises at both sides recesses 5 for the lateral parts of the locking bars 8 such that the locking bars 8 are pivotal in the direction of the arrow 27.

At the lateral longitudinal frame of the first housing half 2, bars 4 are provided, which during the assembly of the housing halves 2, 3 are inserted in a form fitting fashion into the accepts, or recesses, 6 of the second housing half 3 provided for this purpose. This way it is ensured that the housing halves are located directly on top of each other prior to the locking process to align the housing halves. The bars 4 and the accepts, or recesses, 6 of the housing halves 2, 3 serve for a plug-in guidance of the plug-in modules. The bars 4 engage the accepts 6 when the electric contact elements of the plug-in modules of the individual housing halves are inserted into each other. This way it is ensured that the opposite electric contact elements are not required to compensate shearing forces. This measure reduces the wear and tear of the electric plug-in connector.

By pivoting the opposite locking bar 8 in reference to each other (or upwards), the latching cams 9 are guided over the locking pins 13 of the second housing half 3 until the locking pins are located in the recesses 11 of the locking cams 9. The recess 11 extends in the longitudinal direction of the lateral part of the bar.

FIG. 5 shows the locked electric plug-in connector 1. The flanks 17 of the opposite locking bars are aligned parallel in reference to each other in the locked state. By an opposite pivoting of the locking bars 8 (here downwards), the locking is opened and the housing halves 2, 3 can be removed from each other and the plug-in modules can be separated.

The second housing half 3 is provided with a dome housing 24 showing a cable outlet 26.

Electric Plug-in Connector with Locking Bar

| | |
|---|---|
| 1 | System plug-in connector |
| 2 | First housing half |
| 3 | Second housing half |
| 4 | Alignment Bar |
| 5 | Recesses |
| 6 | Recess |
| 7 | Shield |
| 8 | Locking bar |
| 9 | Latching cam |
| 10 | Sealing ring |
| 11 | Recess |
| 12 | Bearing pin |
| 13 | Locking pin |
| 14 | Lateral wall |
| 15 | |
| 16 | Accepting section for plug-in module |
| 17 | Flank (of the shield 7) |
| 18 | Collar |
| 19 | Locking hook |
| 20 | Fastening frame |
| 21 | Latching means |
| 22 | Bearing pin accept |
| 23 | Rail |
| 24 | Dome housing |
| 26 | Cable outlet |
| 27 | Pivotal motion/arrow |
| 28 | Bore hole |
| B | Wall thickness of the bar 8 |

The invention claimed is:

1. An electric plug-in connector, comprising:

a first and a second housing half, with the first housing half (2) including two oppositely positioned U-shaped locking bars (8), each held pivotally on bearing pins (12) and each including latching cams (9) provided with a recess (11), which upon closing of the locking bars (8) each recess acts upon a locking pin (13) of the second housing half (3) such that the two housing halves (2, 3) are pressed and locked against each other, wherein the locking bars (8) include lateral shields (7), which in the locked state of the electric plug-in connector cover both the bearing pins (12) of the first housing half (2) and the locking pins (13) of the second housing half (3), with the respective shields (7) showing a straight flank (17) between a recess (22) for the bearing pins and the locking pins (13), wherein said first housing half (2) includes at least one bar (4) having a raised portion extend longitudinally between each U-shaped locking bar and projecting in the plug-in direction of the first housing half toward the second housing half, said second housing half having a recess (6) extending longitudinally between the locking pins (13) and dedicated to receive the bar (4) during the assembly of the two housing halves (2, 3) with the bar (4) inserted into the recess (6) of the second housing half (3) so that the housing halves are located precisely aligned on top of each other and wherein said first housing half (2) comprises a receiving section (16) for electric contact elements in the form of separate plug-in modules; and wherein said second housing half (3) includes a fastening frame having receiving sections suitable to accept electric contact elements in the form of separate plug-in modules, said fastening frame further includes latching means for latching into recesses of the second half.

2. The electric plug-in connector according to claim 1, characterized in that the flanks (17) of the shields (7) of the opposite locking bars (8) are parallel in reference to each other in the locked state.

3. The electric plug-in connector according to claim 1, characterized in that the receiving section (16) includes latching hooks (19), which can be latched in the allocated recesses in plug-in modules.

4. The electric plug-in connector according to claim 1, characterized in that the first housing half (2) comprises a circumferential collar (18) suitable to accept a sealing ring (10).

5. The electric plug-in connector according to claim 1, characterized in that the locking bar 8 is made from a different material than the housing halves 2, 3.

6. The electric plug-in connector according to claim 5, characterized in that the locking bar is made from metal.

7. An electric plug-in connector comprising a first housing and a second housing, with the first housing engageable and lockable to the second housing, each housing including a substantially rectangular base having lateral longitudinal frame areas that face each other during a locking of the first housing to the second housing, said first housing including two U-shaped locking bars pivotally mounted to sidewalls of the first housing and separated longitudinally from each other, each locking bar including latching cams provided with a recess such that the pivoting of the locking bars engages locking pins located on the second housing so as to lock and press the two housings, and their lateral longitudinal frame areas, against each other, wherein the U-shaped locking bars include lateral shields which, in the locked state of the electric plug-in connector, cover the pivotal connection of the locking bars to the first housing side wall and cover the locking pins of the second housing, said first housing including an elongated alignment bar having a raised portion extending upward from its longitudinal frame area and extending longitudinally between each U-shaped locking bar, said second housing including a recess within its lateral longitudinal frame area and extending longitudinally between the locking pins, said recess sized to receive the raised portion of the elongated alignment bar such that the bar is received within the recess to precisely align the first and second housings with respect to each other prior to, and after, pivoting of the U-shaped locking bars to a locked position; and said second housing having a holding frame having sections for accepting electric contact elements in the form of separate plug-in modules, said holding frame further including latches for latching said holding frame into recesses of the second housing.

8. The electrical plug-in connector of claim 7, wherein said first housing includes a section for accepting electrical contact elements in the form of separate plug-in modules.

9. The electrical plug-in connector of claim 8, wherein said section includes latching hooks for latching the separate plug-in modules.

10. The electrical plug-in connector of claim 7, further comprising a holding frame inserted within said second housing and including holding frame sections for accepting electrical contact elements in the form of separate plug-in modules.

* * * * *